US006799980B2

(12) United States Patent
Bloomfield et al.

(10) Patent No.: US 6,799,980 B2
(45) Date of Patent: Oct. 5, 2004

(54) METHOD AND APPARATUS FOR GROUNDING A PROCESSOR BOARD

(75) Inventors: Rome Bloomfield, Cypress, TX (US); Joseph R. Fester, Tomball, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 80 days.

(21) Appl. No.: 10/039,138

(22) Filed: Dec. 31, 2001

(65) Prior Publication Data

US 2003/0124887 A1 Jul. 3, 2003

(51) Int. Cl.[7] ..... H01R 4/66
(52) U.S. Cl. ..... 439/92; 439/95
(58) Field of Search ..... 439/95, 92, 74, 439/567, 552; 29/450; 174/138 G, 138 D, 16 S, 166 S; 361/804, 758, 816, 789, 752

(56) References Cited

U.S. PATENT DOCUMENTS

| | | | | |
|---|---|---|---|---|
| 4,875,140 A | * | 10/1989 | Delpech et al. | 361/412 |
| 5,108,312 A | * | 4/1992 | Sampson | 439/607 |
| 5,281,149 A | * | 1/1994 | Petri | 439/66 |
| 6,186,800 B1 | * | 2/2001 | Klein et al. | 439/95 |
| 6,424,538 B1 | * | 7/2002 | Paquin | 361/752 |
| 6,519,817 B1 | * | 2/2003 | Lenhart et al. | 24/458 |

* cited by examiner

*Primary Examiner*—Alex Gilman

(57) ABSTRACT

The present invention is adapted for electrically grounding a printed circuit board to a chassis having mounting studs with each stud having an upper nose. The ground clip of the present invention has a generally circular upper body portion with a side opening, and a plurality of retentive leads extending from the upper body portion. Each ground clip is connected to the circuit board around a portion of a mounting hole such that the upper body portion contacts the upper nose to provide electrical grounding of the circuit board to the chassis.

20 Claims, 4 Drawing Sheets

METHOD AND APPARATUS FOR GROUNDING A PROCESSOR BOARD

CROSS-REFERENCE TO RELATED APPLICATIONS

None.

STATEMENTS REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention relates generally to a method and apparatus for grounding circuit boards in electronic devices, and more particularly relates to a method and apparatus for electrically grounding a processor board, such as a printed circuit board, to a chassis.

2. Description of the Related Art

Processor boards, such as printed circuit boards ("PCB") with components mounted thereon referred to as printed circuit assembly or "PCA", are mounted to the chassis of various electronic devices. The mounting of the processor board or PCA to the chassis typically provides needed electrical grounding of the board to the chassis. For example, a server computer uses a processor PCA that requires a grounding means to meet agency EMC compliance. Oftentimes, it is necessary to electrically ground a printed circuit board at several distinct locations on the board. A printed circuit board may include several conductor layers separated by insulator layers. The various conductor layers are electrically connected by vias, or electrical connector barrels, typically of copper, formed in the circuit board through the layers of conductors and insulation. Electrical grounding of these intermediate conductor layers can be accomplished with vias extending through the board to its upper and lower surfaces.

One prior method for PCA mounting and electrical grounding required the use of "blunt nose" standoffs with a companion screw inserted through a hole in the PCA and threaded into the standoff. The standoff and screw were made of electrically conductive materials. The hole in the PCA typically included a grounding pad around the hole on the upper and lower surfaces of the PCB. Thus, electrical grounding was provided to the portion of the PCA in electrical contact with the screw and standoff. However, some system processor boards are quite large and complex and may require for example fifteen or eighteen standoffs. The more screws required, the more time involved in installing and removing the board and also the increased risk of damaging the PCA, as for example, by the air driver bit slipping off the screw head and damaging components on the board. This prior PCA mounting method is labor intensive, but provides effective electrical grounding and securement to the chassis.

Another method currently in use for mounting the PCA involves the usage of "bullet nose" standoffs or mounting studs. The bullet nose mounting studs are attached to the chassis, as for example by pressing them into the chassis. The mounting stud was made of electrically conductive material. A typical bullet nose mounting stud includes a cylindrical base which sharply transitions at an upper base face to a reduced diameter cylindrical stem. The cylindrical stem transitions to an enlarged diameter nose at a lower nose face. The nose has an upper portion generally rounded in shape like a bullet. The diameter of the base portion is greater than the diameter of the nose which is greater than the diameter of the stem for reasons which are explained below.

The PCB includes a keyhole-shaped opening having a generally enlarged circular area connected to a smaller throat area. The enlarged circular area is larger in diameter than the mounting stud nose but smaller in diameter than the upper base face to allow the enlarged circular area of the PCB opening to be lowered over the nose and onto the upper base face. With all of the PCB openings positioned onto the mounting studs, the PCB is slid such that the mounting stud stems are received in the smaller throat area of the keyhole-shaped openings. Typically, the height of the stem (which is the distance between the upper base face and the lower nose face) is slightly greater than the thickness of PCB to permit sliding action and also to allow for manufacturing tolerances. The width of the throat area is less than the diameter of the lower nose face such that the PCB is restrained in the direction of the longitudinal axis of the mounting stud between the lower nose face and the upper base face. A grounding pad was included around the end of the throat area on the upper and lower surfaces of the PCB to provide electrical grounding by contact with the mounting stud.

The "bullet nose" mounting studs for PCA mounting do not effectively provide continuous electrical grounding of the PCA to the system chassis. This is due primarily to manufacturing tolerances involved in the manufacture of the PCB and the mounting studs. Additionally, it is necessary to have some "play" in order to be able to slide the PCB into the throat area. Furthermore, typically a few of the mounting studs are replaced with blunt nose standoffs with a companion screw and a round hole rather than the keyhole-shaped opening to secure the PCA and provide continuous electrical grounding. The use of screws again increases the time and risk of damage as explained above.

It is desirable to have an electrical grounding device for continuously grounding a processor board to a chassis using standard bullet nose mounting studs and keyhole-shaped openings. It is also desirable that any new electrical grounding device for use with bullet nose mounting studs be cost sensitive, easily manufactured, highly reliable, and designed for mass production.

BRIEF SUMMARY OF THE INVENTION

The present invention is an electrical ground clip for grounding a processor board to a chassis using standard bullet nose mounting studs and keyhole-shaped openings. The ground clip of the present invention is cost sensitive, easily manufactured, highly reliable, and designed for mass production.

One embodiment of the ground clip of the present invention includes a generally circular-shaped upper body portion, and a lower portion with a number of contiguously attached, peripherally spaced retentive leads. The upper body portion contains a peripheral side opening opposite the peripherally spaced retentive leads. Upper body ends at the side opening are formed outwardly at an angle to receive a bullet nose mounting stud or standoff attached to a chassis. The inner diameter of the ground clip's circular-shaped upper body portion is smaller than the diameter of the nose of the mounting stud. The retentive leads of the ground clip's lower portion are inserted through corresponding holes in grounding pads located at one end of a keyhole-shaped opening in a processor PCB. The retentive leads are soldered by conventional means to the PCB to ensure electrical contact of the ground clip to the PCB.

The PCA contains keyhole-shaped openings and is installed over the bullet nose mounting studs. Initially, the PCB is positioned over the nose of the mounting studs and brought into contact with the upper base face of the mounting stud. As the PCB is slid towards its final position, the upper and lower surfaces of the PCB are loosely captured by the upper base face and the lower nose face of the mounting stud. The mounting stud stem is smaller in diameter than the upper base face and lower nose face, and smaller than the throat area of the keyhole-shaped opening in the PCB. As the PCB reaches its final position, the upper body portion of the ground clip engages the nose of the mounting stud, springs open, then returns to a position that partially surrounds and makes firm contact with the nose of the mounting stud. The firm contact of the ground clip around the mounting stud nose provides continuous electrical grounding.

The ground clip of the present invention is compatible with existing components and mounting techniques. The present invention is soldered to the processor board and electrically grounds the processor board to the chassis via the bullet nose mounting studs used to secure the processor board to the server chassis. The ground clip can be manufactured at low cost and be easily implemented. In addition to providing consistent electrical grounding of the processor board to the chassis, it also includes the benefits of easier and quicker installation of the processor board to the chassis. The ground clip of the present invention can be installed by conventional means by the manufacturer of the PCA. The present invention eliminates the risk of damage to the PCA caused by an air driver bit slipping off a screw head and damaging components on the board.

BRIEF DESCRIPTION OF THE SEVERAL VIEWS OF THE DRAWINGS

In order to more fully understand the drawings referred to in the detailed description of the invention, a brief description of each drawing is presented, in which.

DETAILED DESCRIPTION OF THE INVENTION

Figure 1:
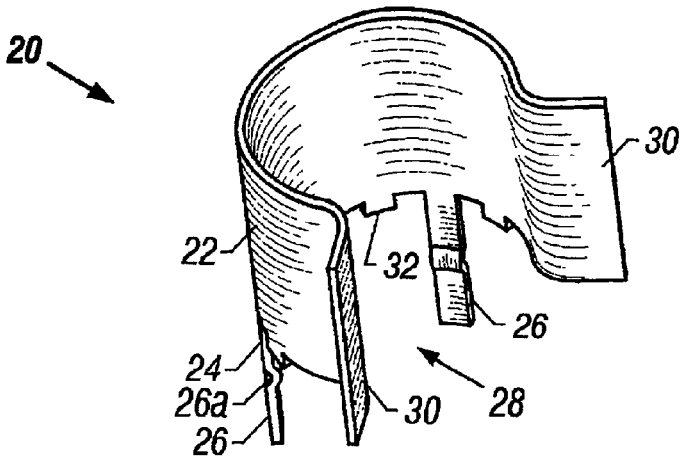
FIG. 1 is a top, front and left-side perspective view of a ground clip according to a preferred embodiment of the present invention.
Figure 2:
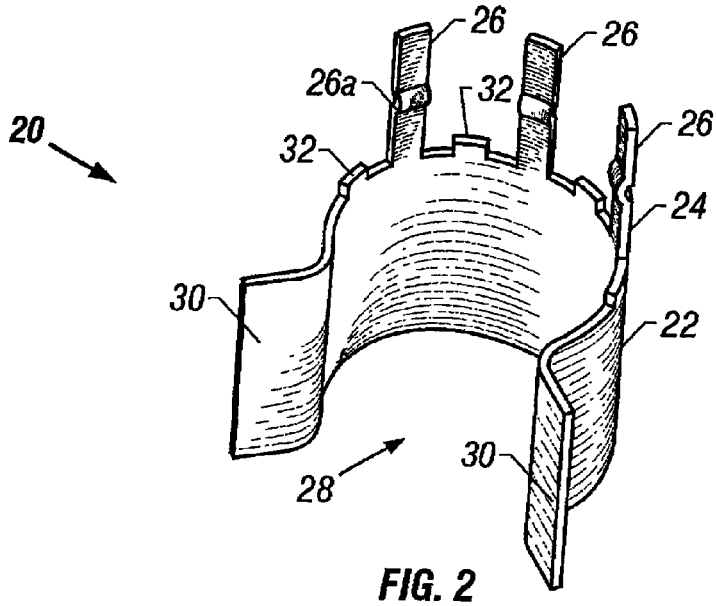
FIG. 2 is a bottom, front, and right-side perspective view of the ground clip of FIG. 1.
Figure 6:
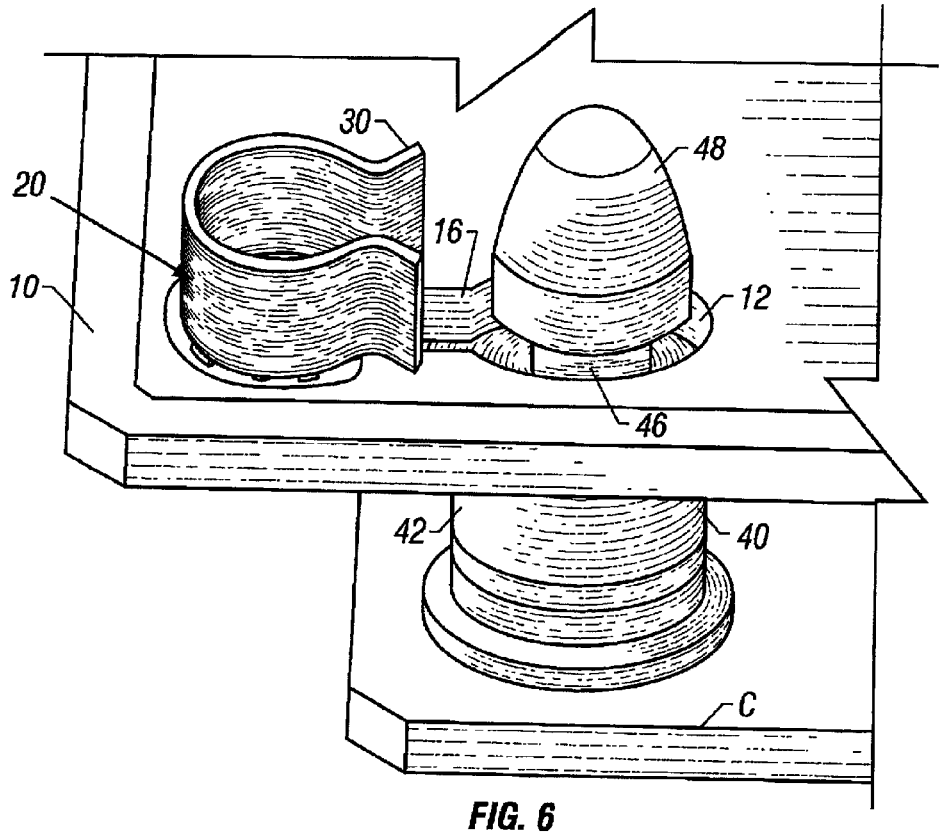
FIG. 6 is a view of the processor board lowered onto the mounting stud.
Figure 7:
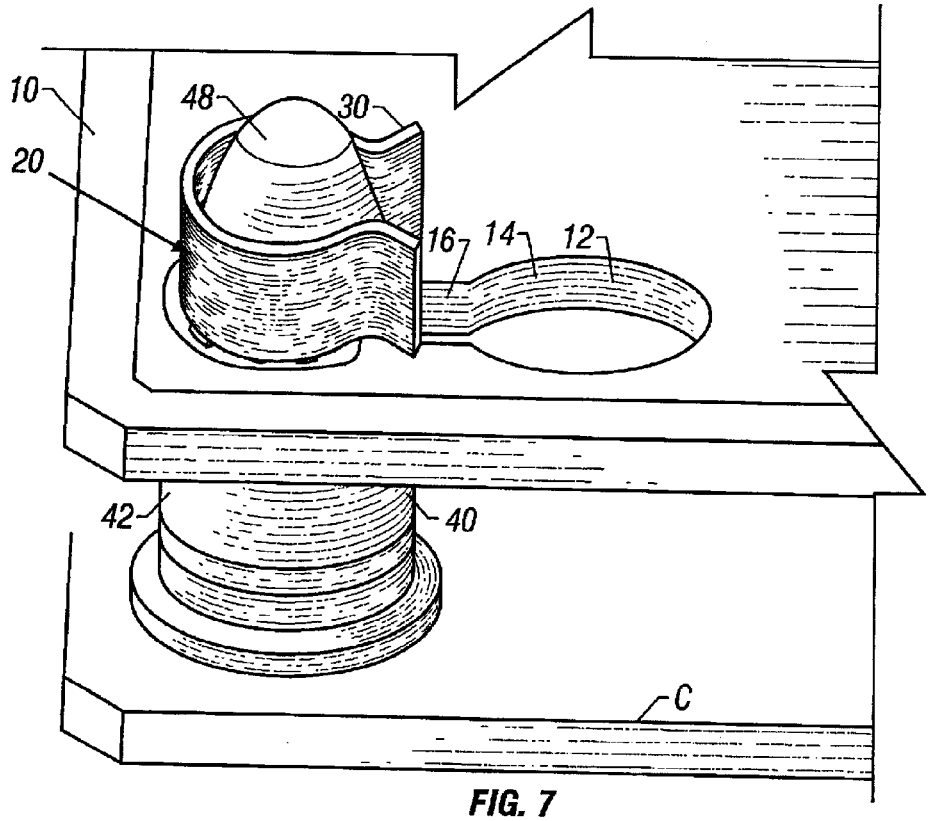
FIG. 7 is a view of the mounting stud received in the grounding clip.
Figure 9:
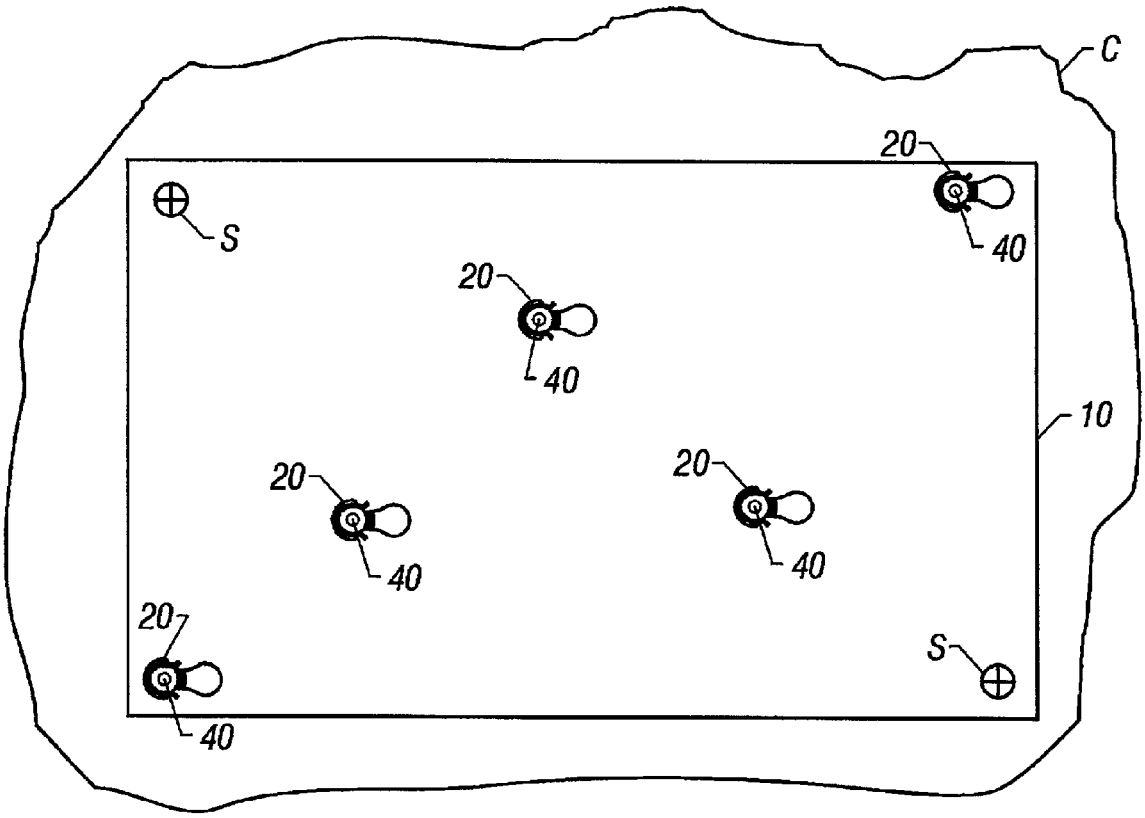
FIG. 9 is a top plan view of a processor board mounted and grounded to the chassis with the grounding clips of the present invention.

The ground clip of the present invention, generally referred to as 20, will now be discussed with specific reference to the drawings. The preferred embodiment of the ground clip 20 is shown in FIGS. 1 and 2. As shown in FIG. 9, the ground clip 20 is particularly well suited for use in mounting a processor board 10, as for example a printed circuit board ("PCB") to a chassis C with a plurality of bullet nose standoffs or mounting studs 40. The bullet nose mounting studs 40 are attached to the chassis C, as for example by pressing them into the chassis C (FIGS. 6 and 7).

In the preferred embodiment of the present invention as shown in FIGS. 1 and 2, the ground clip 20 includes a generally circular-shaped upper body portion 22, and a lower portion 24 with a number of contiguously attached, peripherally spaced retentive leads 26. The retentive leads 26 may include a teat 26*a* along the length of the retentive lead 26. The upper body portion 22 contains a peripheral side opening 28 opposite the peripherally spaced retentive leads 26. Upper body ends 30 at the side opening 28 are formed outwardly at an angle to receive the bullet nose mounting stud 40 attached to the chassis C. The ground clip 20 may include a plurality of stanchions 32 extending from the lower end of the upper body portion 22. The ground clip 20 can be manufactured using conventional means, for example sheetmetal forming. The ground clip 20 is made of an electrically conductive material. For example, the ground clip 20 may be made of beryllium copper sheet with tin lead plating (or comparable plating).

Figure 3:
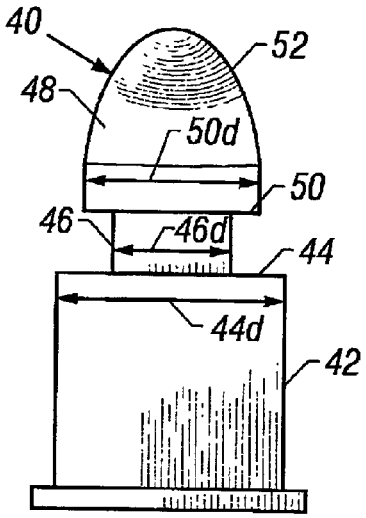
FIG. 3 is a side elevation view of the bullet-nose mounting stud.

As shown in FIG. 3, a typical bullet nose mounting stud 40 includes a cylindrical base 42 which sharply transitions at an upper base face 44 to a cylindrical stem 46 having a reduced diameter 46*d*. The cylindrical stem 46 transitions to an enlarged diameter nose 48 at a lower nose face 50 having a diameter 50*d*. Preferably, the nose 48 has an upper portion 52 generally rounded in shape like a bullet. Alternatively, the nose 48 may have other generally rounded shapes, including a cylindrical shape. As shown in FIG. 3, the diameter 44*d* of the upper base face 44 is greater than the diameter 50*d* of the nose lower face 50 and the diameter 50*d* of the nose lower face 50 is greater than the stem diameter 46*d* for reasons which are explained below. The mounting stud 40 is made of an electrically conductive material.

Figure 4:
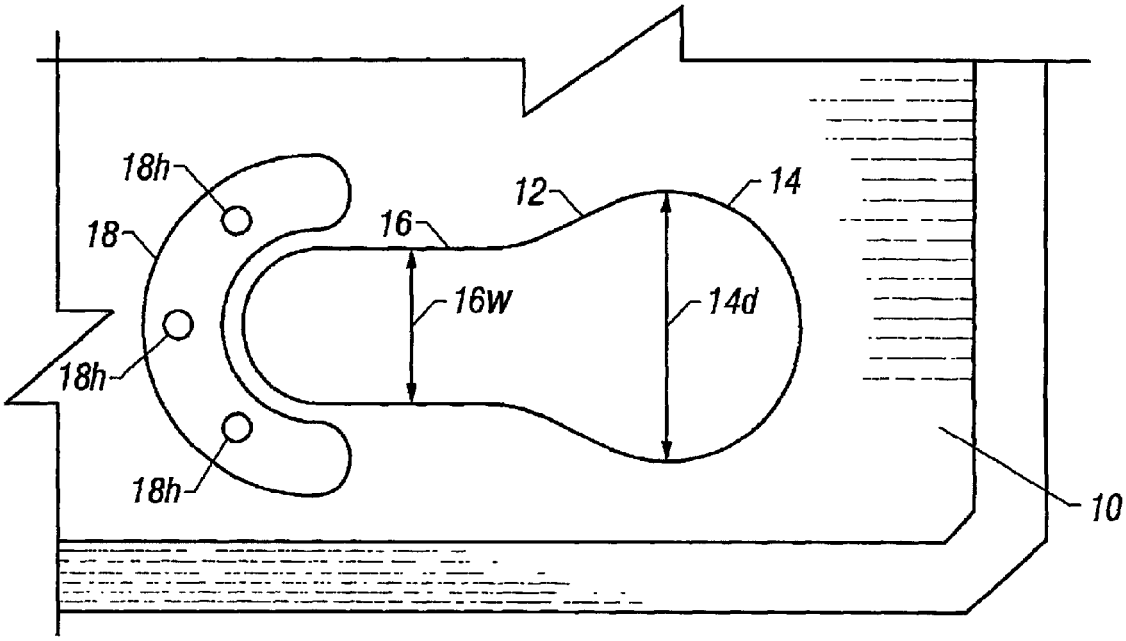
FIG. 4 is a top plan view of the processor board showing a keyhole-shaped opening and a grounding pad having a plurality of holes therethrough.

Referring to FIG. 4, the PCB 10 preferably includes a keyhole-shaped opening 12 having a generally enlarged circular area 14 connected to a smaller throat area 16. The enlarged circular area 14 has a diameter 14*d* larger than the diameter 50*d* of the mounting stud nose lower face 50 but smaller than the diameter 44*d* of the upper base face 44 to allow the enlarged circular area 14 of the PCB opening 12 to be lowered over the nose 48 and onto the upper base face 44. The width 16*w* of the throat area 16 is less than the diameter 50*d* of the lower nose face 50 such that the PCB 10 is restrained in the direction of the longitudinal axis of the mounting stud 40 between the lower nose face 50 and the upper base face 44 upon installation of the PCB 10.

Referring to FIG. 4, preferably a grounding pad 18 is positioned on the upper and lower surfaces of the PCB 10 at the end of the throat area 16. Preferably, the grounding pad 18 includes a plurality of holes 18*h* extending through the PCB 10. The holes 18*h* preferably include an electrical connector barrel extending through the PCB 10 and in contact with the pair of upper and lower grounding pads 18. The holes 18*h* are spaced to correspond to the spacing of the retentive leads 26 and each hole 18*h* is capable of receiving a corresponding ground clip retentive lead 26.

Figure 5:
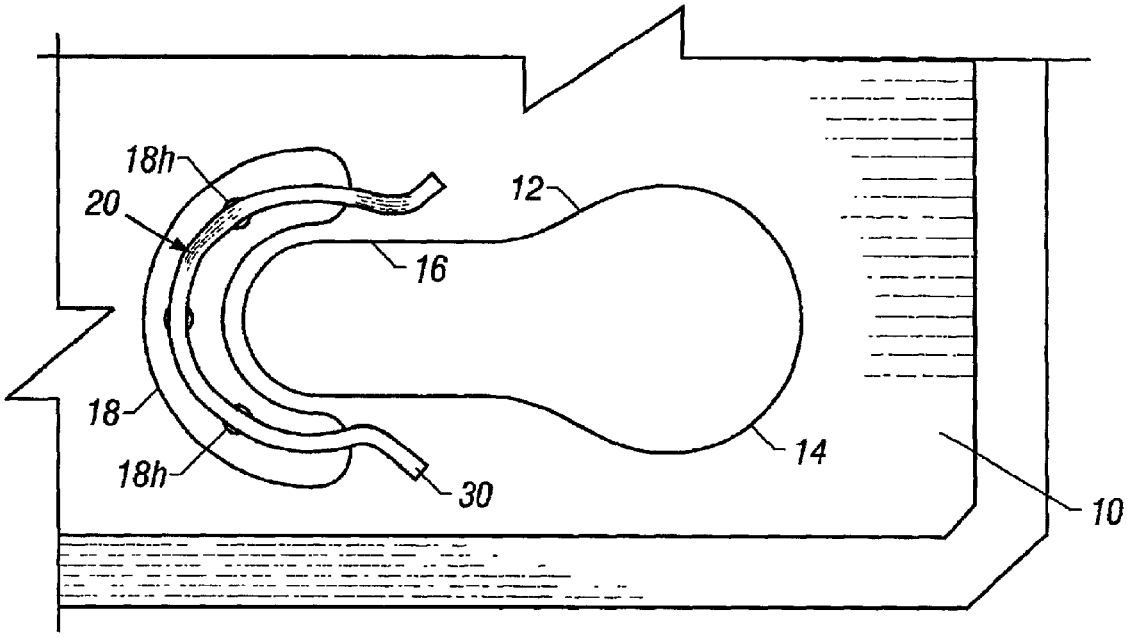
FIG. 5 is a top plan view of the ground clip of the present invention installed on a processor board.

The ground clip 20 is installed by inserting the retentive leads 26 into and through the holes 18*h* from the upper surface of the PCB 10 as shown in FIG. 5. The ground clip

20 is supported by the stanchions 32 contacting the upper grounding pad 18. Although not shown, preferably the retentive leads 26 extend slightly below the lower surface of the PCB 10 with the teats 26*a* positioned within the holes 18*h*. The teated retentive leads 26 preferably include a slight bias or spring force to provide a retention force within the holes 18*h* to maintain the ground clip 20 in the proper position during the soldering process. The retentive leads 26 are preferably soldered by conventional means, for example a flow solder machine, to the PCB 10 providing electrical grounding of the ground clip 20 to the PCB 10. It is to be understood that the ground clips 20 may be soldered to the PCB 10 at the same time other components are being soldered to the PCB 10. If desired, the lower extremities of the retentive leads 26 may be clipped after soldering.

Preferably, the stanchions 32 are not soldered to the upper grounding pad 18. The stanchions 32 prevent the upper body portion from being soldered directly to the PCB 10 and thus allows flexure of the body ends 30 upon receiving the bullet nose 48 as described below. Preferably, the retentive leads 26 and the stanchions 32 are not located near the clip opening 28 because of the flex needed at the upper body ends 30 to receive the bullet nose 48 of the mounting stud 40.

Installation of the PCB 10 will now be described. The enlarged circular areas 14 of the keyhole-shaped openings 12 of the PCB 10 are positioned over the bullet nose mounting studs 40. The PCB 10 is lowered over the nose 48 of the mounting studs 40 and brought into contact with the upper base face 44 of the mounting stud 40 as shown in FIG. 6. The diameter 46*d* of the mounting stud stem 46 is smaller than the width 16*w* of the throat area 16 of the keyhole-shaped opening 12 in the PCB 10. With all of the PCB openings 12 positioned onto the mounting studs 40, the PCB 10 is slid such that the mounting stud stems 46 are received in the smaller throat area 16 of the keyhole-shaped openings 12. Typically, the height of the stem 46 (which is the distance between the upper base face 44 and the lower nose face 50) is slightly greater than the thickness of the PCB 10 to permit sliding action and also to allow for manufacturing tolerances. The upper and lower surfaces of the PCB 10 are loosely captured by the upper base face 44 and the lower nose face 50 of the mounting stud 40.

Figure 8:
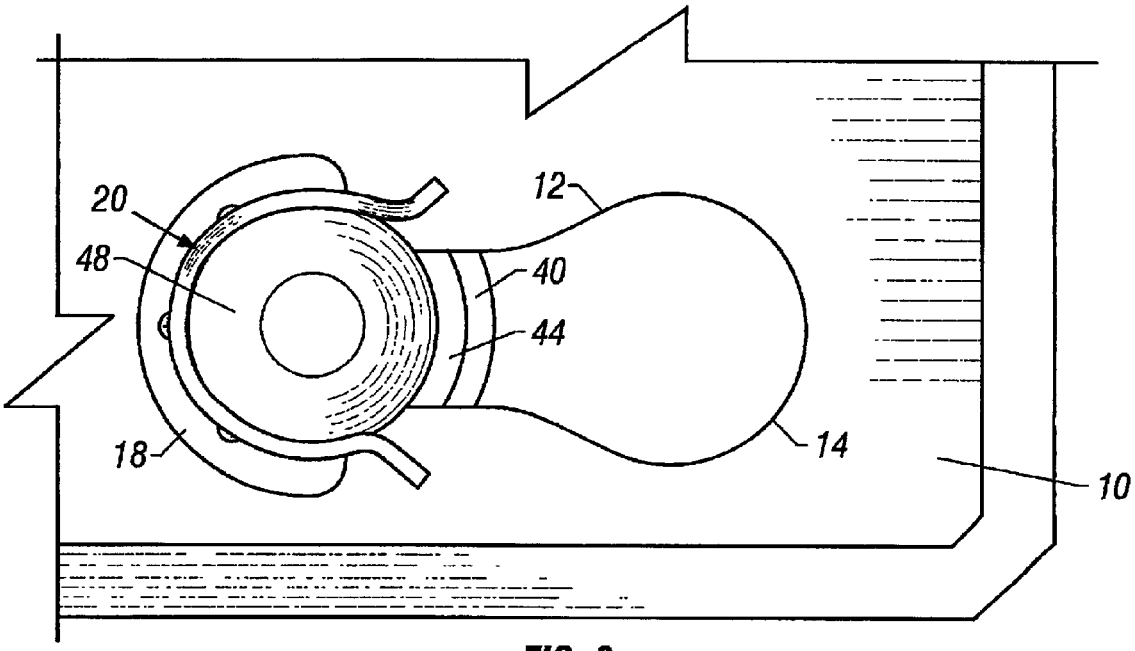
FIG. 8 is a top plan view of a typical bullet-nose mounting stud received in the grounding clip.

Preferably, the inner diameter of the ground clip's circular-shaped upper body portion 22 is smaller than the diameter 50*d* of the mounting stud nose 48. As the PCB 10 reaches its final position, the upper body portion 22 of the ground clip 20 engages the nose 48 of the mounting stud 40, springs open, then returns to a position that partially surrounds and makes firm contact with the mounting stud nose 48 as shown in FIGS. 7 and 8. The firm contact of the ground clip 20 around the mounting stud nose 48 provides the electrical ground between that portion of the PCB 10 and the chassis C.

As shown in FIG. 9, it may be desirable to include one or more circular holes and blunt nose standoffs with companion screws S on the PCB 10 to secure the PCB 10 to the chassis. However, it is to be understood that this should be kept to a minimum because of the increased risk of damaging the PCA and the increased time to install and remove the screws.

The foregoing disclosure and description of the invention are illustrative and explanatory thereof, and various changes in the details of the illustrated apparatus and construction and method of operation may be made without departing from the spirit of the invention.

We claim:

1. A method of electrically grounding a circuit board to a chassis comprising the steps of:

attaching an electrically conducting mounting stud to chassis;

attaching a ground clip adjacent a mounting hole in the circuit board;

extending a portion of the mounting stud through the mounting hole; and positively engaging the ground clip with opposite sides of the portion of the mounting stud.

2. The method of claim 1, wherein the ground clip is attached to an upper surface of the circuit board.

3. The method of claim 1, further comprising the step of mounting the circuit board to the chassis by extending a mounting stud nose of the portion through the mounting hole.

4. The method of claim 1, wherein the step of positively engaging the ground clip with the mounting stud includes receiving a mounting stud nose of the portion in a biased clip opening.

5. The method of claim 1, wherein the step of attaching a ground clip includes soldering the ground clip to the circuit board.

6. The method of claim 5, wherein the step of attaching a ground clip includes extending ground clip leads through lead holes in the circuit board.

7. A ground clip apparatus adapted to engage a mounting stud nose for electrically grounding a circuit board to a chassis, the apparatus comprising:

a generally circular upper body portion having a side opening adapted to spring open about the mounting stud nose as the mounting stud nose enters the opening; and a plurality of retentive leads extending from the upper body portion, the plurality of retentive leads adapted for insertion through holes in the circuit board.

8. The apparatus of claim 7, further comprising a plurality of stanchions extending from the lower end of the upper body portion.

9. The apparatus of claim 7, wherein the upper body portion includes outwardly flared ends adjacent the side opening.

10. The apparatus of claim 7, wherein the plurality of retentive leads are substantially opposite the side opening.

11. The apparatus of claim 7, wherein each retentive lead is biased to provide a retention force.

12. The apparatus of claim 11, wherein each retentive lead includes a teat.

13. In a printed circuit board adapted for mounting in a chassis having a plurality of mounting studs having an upper nose, the printed circuit board having a plurality of mounting holes adapted to receive the upper nose of the mounting studs, the improvement comprising:

a plurality of ground clips, each ground clip having a generally circular upper body portion with a side opening adapted to spring open about the unper nose as the upper nose enters the opening, and a plurality of retentive leads extending from the upper body portion, each ground clip connected to the printed circuit board around a portion of a mounting hole, wherein the generally circular upper body portion is in contact with the upper nose to provide electrical grounding of the printed circuit board to the chassis.

14. The improvement of claim 13, wherein each ground clip is positioned so that the side opening faces the mounting hole.

15. The improvement of claim 13, further comprising a plurality of stanchions extending from the lower end of the upper body portion.

16. The improvement of claim 13, wherein the upper body portion includes outwardly flared ends adjacent the side opening.

17. The improvement of claim 16, wherein the outwardly flared ends are allowed to flex outwardly to receive the upper nose of the mounting stud.

18. The improvement of claim 13, wherein the printed circuit board includes a plurality of lead holes for each ground clip, the plurality of lead holes corresponding to the plurality of retentive leads of each ground clip, the retentive leads inserted into the lead holes for attaching each ground clip to the printed circuit board.

19. The improvement of claim 18, wherein each retentive lead is biased to provide a retention force.

20. The improvement of claim 18, wherein the plurality of retentive leads are substantially opposite the side opening.

* * * * *